United States Patent [19]

Bridle et al.

[11] 3,948,029

[45] Apr. 6, 1976

[54] STRING-UP AND CUT-DOWN DEVICE FOR A RING TWISTER

[75] Inventors: Trevor R. Bridle, Brockville; Christopher S. M. Godfrey; David C. Riley, both of Kingston, all of Canada

[73] Assignee: Du Pont of Canada, Ltd., Montreal, Canada

[22] Filed: Nov. 7, 1974

[21] Appl. No.: 521,853

[30] Foreign Application Priority Data

Dec. 21, 1973 Canada ..... 188828

[52] U.S. Cl. ..... 57/34 TT; 57/34.5; 57/54; 242/18 PW

[51] Int. Cl.[2] ..... D01H 1/40

[58] Field of Search..... 57/34 R, 34 TT, 54, 156, 57/34.5; 242/18 EW, 18 PW

[56] References Cited

UNITED STATES PATENTS

| | | | |
|---|---|---|---|
| 2,855,748 | 4/1958 | Baumgarten et al. | 57/34 TT |
| 2,955,409 | 10/1960 | Speakman | 57/34 TT |
| 3,095,683 | 7/1963 | Tessmer | 57/34 TT |
| 3,122,874 | 3/1964 | Tessmer et al. | 57/34 TT |
| 3,263,408 | 8/1966 | Mansfield et al. | 57/34 TT |
| 3,263,409 | 8/1966 | Zuidema | 57/156 |
| 3,283,489 | 11/1966 | Bakker | 57/34 TT |
| 3,319,409 | 5/1967 | Bakker | 57/34 TT |
| 3,813,864 | 6/1974 | Cochran | 57/34 TT |

FOREIGN PATENTS OR APPLICATIONS

| | | |
|---|---|---|
| 765,641 | 8/1967 | Canada |

*Primary Examiner*—John Petrakes

[57] ABSTRACT

An apparatus for stringing up a rotating package holder on a ring twister with a yarn being fed to a waste jet. A rotatable pulley with a yarn guide attached is used to intercept the yarn and move it into engagement with a cutter attached to the waste jet and a yarn snagging means adjacent the package holder. The waste jet-cutter combination is also designed to cut down a full package at the completion of a winding cycle.

4 Claims, 6 Drawing Figures

STRING-UP AND CUT-DOWN DEVICE FOR A RING TWISTER

BACKGROUND OF THE INVENTION

The present invention relates to the production of synthetic yarns in which subsequent to melt spinning the yarn is drawn and twisted on an apparatus sometimes hereinafter referred to as a drawtwister. In particular, the invention is directed to a string-up and cut-down device on a drawtwister.

The production of synthetic yarns often involves a two step process, that is, first, unoriented filaments are melt spun and wound onto bobbins; second, a creel of these bobbins is used to supply a drawtwister which draws or orients the filaments, twists them together and winds the resultant yarn onto pirns.

A method of producing synthetic yarns in which the filaments are melt spun, drawn, twisted and wound onto pirns without the intermediate step of bobbin winding has been shown to be possible and to have the advantages of reducing labor requirements and of improving yarn quality. However, conventional drawtwisters are designed to operate with a creel of passive bobbins and are not designed to handle a continuously flowing supply during periods when the yarn is not being wound onto the pirn.

It is an object of this invention to provide a means with which a conventional drawtwister, employing a conventional ring twisting technique, may be adapted to accommodate a continuous supply of yarn.

It is also an object of this invention to provide a string-up apparatus which may be operated manually on an individual position of a drawtwister or automatically and simultaneously over all the drawtwister positions while the drawtwister is running with a continuous supply of yarn.

It is a further object of this invention to provide a means by which a drawtwister may be left strung up and running during doffing.

It is yet another object of this invention to provide an automatic cut-down means which may be operated manually on individual positions or automatically and simultaneously over all positions of the drawtwister being adapted to stop the yarn from winding onto the pirn without interrupting continuous supply which remains running through the drawtwister.

SUMMARY OF THE INVENTION

In a ring twister for winding yarn on the surface of a pirn carried by a rotating spindle including a ring positioned concentric with and mounted for traversing said spindle, said ring having a freely rotatable traveller through which yarn passes in a path past a yarn disposal means to the spindle, means for traversing said ring, and means for snagging the yarn mounted at the base of the spindle, the improvement comprising: a rotatable pulley mounted adjacent said yarn snagging means, said pulley being concentric with said spindle and having a diameter less than said ring; means for rotating said pulley; cutting means attached to said yarn disposal means; and a guide attached to said pulley for engaging said yarn as said pulley is rotated and moving said yarn into engagement with said cutter and said snagging means.

DETAILED DESCRIPTION OF THE PREFERRED EMBODIMENT

Figure 1:
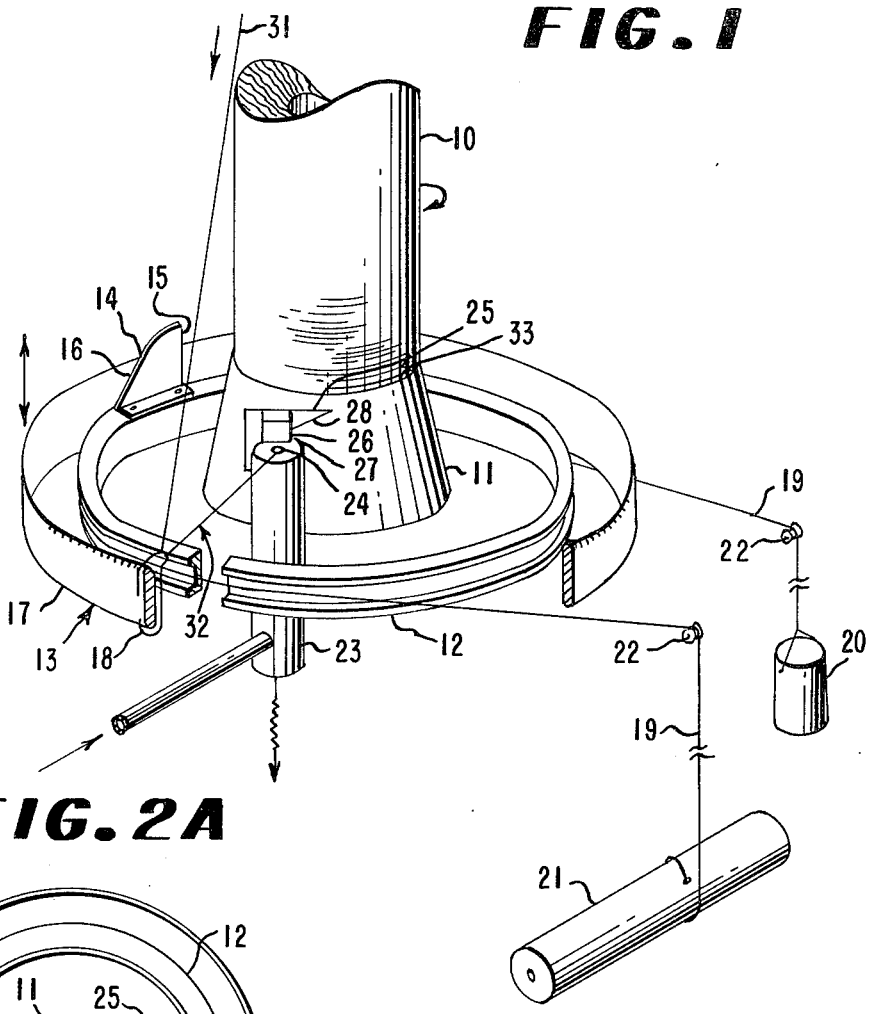
FIG. 1 is a schematic representation of a preferred embodiment of this invention on one position of a drawtwister.
Figure 2A:
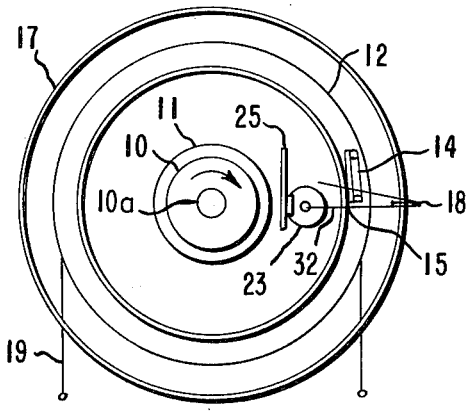
FIG. 2A is a plan view of this preferred embodiment just prior to string up (one position only).
Figure 2B:
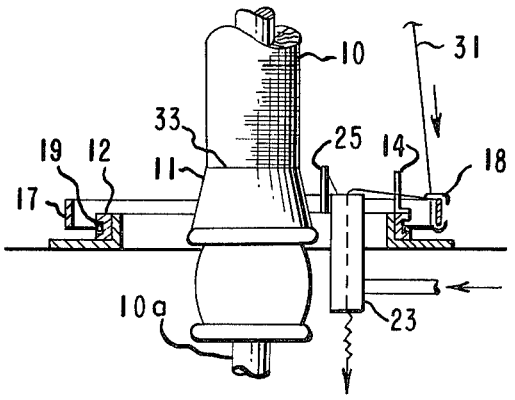
FIG. 2B is a front elevation of the apparatus shown in FIG. 2A.
Figure 3A:
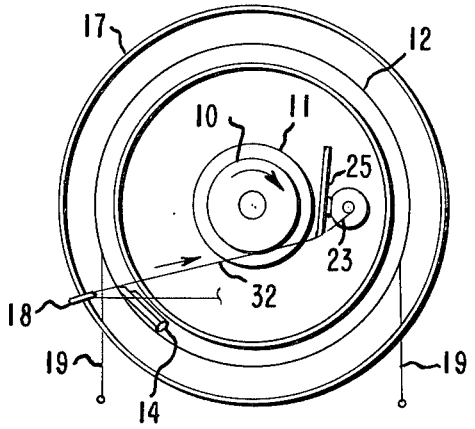
FIG. 3A is a plan view showing the initial step in string up (one position only).
Figure 3B:
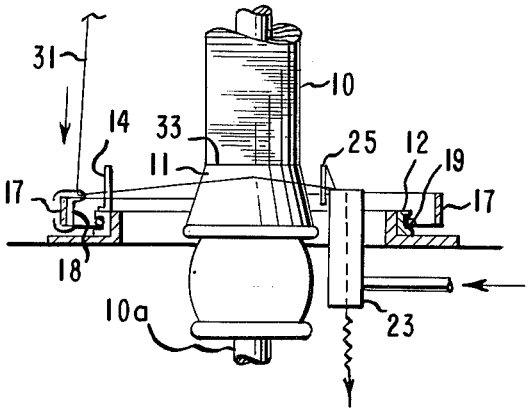
FIG. 3B is a front elevation of the apparatus in the position shown in FIG. 3A.

In the embodiment of the invention shown in FIG. 1, a pirn 10 is seated on a snag means 11 while mounted on the drawtwister's driving spindle (10*a*, FIGS. 2B and 3B). Concentrically surrounding the snag means 11 is a pulley 12 and a ring twister means 13. A string-up guide 14 is attached to the upper face of the pulley 12. The string-up guide 14 resembles a shark fin in that one edge 15 is perpendicular to the pulley face while the other edge 16 is sloped away from the said face in a smooth curve to meet the perpendicular edge. The ring twisting means 13 consists of a traveller ring 17 and a traveller 18 which is free to slide around said traveller ring 17. Traveller ring 17 is adapted to move vertically up and down the length of the pirn 10 as indicated by the reversing arrow in the conventional manner by means not shown.

A cord 19 is wrapped around the pulley 12. One end of said cord 19 is attached to a counterweight 20 while the other is attached to and wound about a gang roller 21. Direction changes in the cord 19 in its respective courses to the counterweight 20 and the gang roller 21 are achieved by appropriately positioned guides 22. The pulley 12 is positioned slightly lower than the traveller ring 17 when the traveller ring 17 is at its lowest position to allow the cord 19 to pass below said traveller ring 17 without obstructing the traveller 18.

A disposal means 23, powered by compressed air, is positioned so that its intake opening 24 is located below the top of the snag means 11 and about the top of the traveller ring 17, when said traveller ring 17 is in its lowest position. In another plane the intake opening 24 lies between the pulley 12 and the snag means 11 along a diameter of said pulley 12 that if extended would pass through the centers of the pirns on adjacent positions of the drawtwister. The intake opening 24 may lie to the left or right of the pirn 10 when viewed by one facing the drawtwister in this embodiment. This last location is determined by the relationship of the driving belts to the spindle on the particular position of the drawtwister. Both left and right hand locations were used to avoid the belts. It will be appreciated that on other drawtwisters of different design, the positioning would be suitably adapted.

A cut-down guide 25 and a cutting blade 26 are mounted above the disposal means 23, on the side 27 of said disposal means 23 closest to the snag means 11.

The cut-down guide 25 has a slanting edge 28 which terminates at the intersection of the said edge 28 and the top of disposal means 23. The slanting edge 28 is sharpened near the intersection to form a cutting blade 26 which lightly presses against the top of the disposal means 23.

Each position on the drawtwister is similarly fitted. The gang roller 21 therefore runs the full length of the drawtwister having attached to it the cords 19 from all the positions of said drawtwister.

Figure 4:
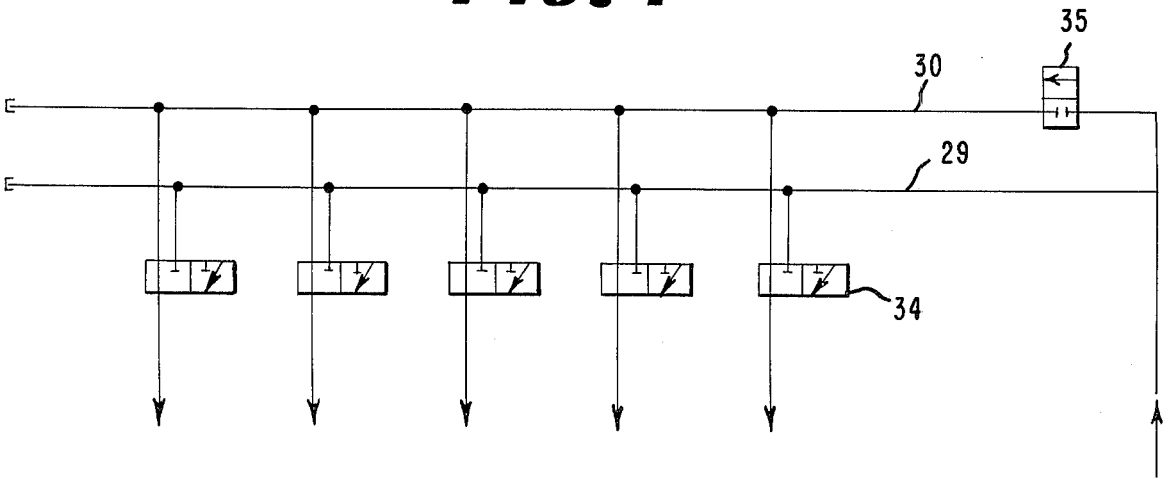
FIG. 4 is a schematic diagram of manifolds used to provide compressed air.

The disposal means 23 at each position are connected by valves 34 to an individual operation manifold 29 and a gang operation manifold 30 shown in FIG. 4 which allows individual or simultaneous control of the air supply to the disposal means.

The interaction of these components during string-up may now be described with the air of FIGS. 1, 2A, 3A and 3B. The description will be of a drawtwister position which puts Z twist in the yarn. For S twist, the spindle will rotate in the opposite direction and the apparatus will be appropriately reversed.

In preparation for string-up, the yarn 31 (FIG. 1) is led through the traveller 18 over the pulley 12 and into the intake opening 24 of the disposal means 23. The traveller ring 17 is in its lowest position. A new pirn 10 is seated on a spindle 10*a* fitted with a snag means 11 which is not turning. The string-up guide 14 is positioned so that its perpendicular edge 15 will be adjacent to the horizontal section 32 of yarn now running continuously between the traveller 18 and the disposal means 23. The spindle is now started so that the pirn 10 and the snag means 11 rotate clockwise.

The pulley 12 may be rotated with cord 19 by rolling up said cord 19 on the gang roller 21. To reverse the rotation of the pulley 12, the gang roller 21 is unrolled and the cord 19 is pulled in the other direction by the counterweight 20.

The string-up guide 14 is attached to the pulley 12 which is connected by cord 19 to gang roller 21 so that movement of the said string-up guide 14 may be controlled by the gang roller 21.

To commence string-up, the perpendicular edge 15 of the string-up guide 14 is now moved against the horizontal section 32 of yarn 31 (FIGS. 2A and 2B) so that it pushes said horizontal section 32 radially around the disposal means 23 so that said horizontal section 32 is thereby brought into contact with the rotating snag means 11 (FIGS. 3A and 3B).

At this time, the traveller ring 17 is raised to its regular winding traverse. As the ring rises, the yarn passes into a crack 33 formed between the bottom of the pirn 10 and the top of snag means 11. Within the crack 33 lies a disk of sandpaper (not shown) slightly recessed into the top of said snag means, which causes the yarn to snag. Once snagged, the yarn breaks between the disposal means 23 and the pirn 10 and starts to wind on the pirn as the traveller ring 17 continues to rise.

In this preferred embodiment, the snag means 11 has the shape of a truncated cone having its base affixed to the spindle. This shape causes the horizontal section 32 of yarn to meet the crack 33 of the snag means and pirn joint at a preferred angle so as to facilitate entry into said crack 33.

It will be appreciated that in other embodiments the snag means 11 may employ means to cause snagging other than a crack lined with sandpaper.

The interaction of the components during cut-down may be described with the aid of FIG. 1.

The yarn is winding on the pirn 10 in normal fashion when the traveller ring 17 is lowered to its lowest position for doffing. As said traveller ring 17 is lowered, the yarn between the traveller 18 and the pirn 10 is caught by the cut-down guide 25 which is mounted above the disposal means 23. The horizontal section 32 of yarn 31 is guided down to the disposal means 23 and across the cutting edge of cutter blade 26. Thus trapped, the tension in the yarn between said cutter blade 26 and the pirn 10 causes the yarn to break at the cutter blade 26 whereupon the free end of the horizontal section 32 of yarn 31 is drawn into the intake opening 24 of the disposal means 23 and carried to waste. At this point, the spindle may be stopped for doffing pirn 10.

During the cut down, the string-up guide 14 is positioned just ahead of cut-down guide 25 so that the sloping edge 16 of string-up guide 14 is presented to the yarn and the yarn rises up and over guide 14 avoiding guide 25 until traveller ring 17 is low enough for the yarn to be pulled down the perpendicular edge 15 of guide 14 and into guide 25. This delay caused by guide 14 ensures that the traveller ring 17 is low enough so that the yarn is immediately pressed to the disposal means 23 once caught by guide 25.

Although the string-up and cut-down action described has been for one position, the action may be made to occur simultaneously on all positions of the drawtwister.

Drawtwister spindles are usually driven from a central gang shaft called the cylinder shaft which runs the length of the drawtwister. Thus, by starting or stopping the cylinder shaft, all the spindles start or stop simultaneously. The cylinder shaft may be driven by its own motor or from a main drawtwister motor through a clutch. Individual positions may be stopped independently of others by using an individual spindle brake usually supplied on drawtwisters.

The traveller rings may be connected to a layrail by a quick release catch. By lowering the layrail to its lowest position, all traveller rings are lowered. With the quick release catch individual rings may be lowered when the layrail is in the winding position.

As mentioned previously, the rotating string up guides 14 are each controlled by a cord 19 which may be connected to a gang roller 21 running the length of the drawtwister which may control them for all positions of the drawtwister simultaneously.

The string-up guide 14 may be operated on an individual position by manually pulling cord 19 towards the gang roller 21 so that guide 14 is reset for string up. Upon releasing cord 19 to the force of counterweight 20, cord 19 will cause guide 14 to drag the horizontal section 32 of yarn around to the bottom of the snag means 11. Thereafter the traveller ring 17 may be manually raised to connect to the layrail thereby engaging the horizontal section 32 of yarn with the upper portion of the snag means 11 which causes string up to occur as previously described.

The disposal means may be controlled by a three-way valve 34 on the air supply and the two manifolds 29 and 30 will permit either individual or simultaneous operation. A two-way valve 35 permits the air supply to gang operation manifold 30 to be turned off when the aspirators 23 are not required such as during winding.

What is claimed is:

1. In a ring twister for winding yarn on the surface of a pirn carried by a rotating spindle including a ring positioned concentric with and mounted for traversing said spindle, a yarn disposal means located near the base of the spindle, said ring having a freely rotatable traveller through which yarn passes in a path past the yarn disposal means to the spindle, means for traversing said ring, and means for snagging the yarn mounted at the base of the spindle, the improvement for use in string-up and doffing the pirn comprising: a rotatable pulley mounted adjacent said yarn snagging means, said pulley being concentric with said spindle and having a diameter less than said ring; means for rotating said pulley; cutting means attached to said yarn disposal means; and an upstanding fin shaped guide attached to said pulley for engaging said yarn as said pulley is rotated and moving said yarn into engagement with said cutter at doffing and said snagging means at string-up.

2. The apparatus as claimed in claim 1, in which the disposal means is an aspirator powered by compressed air.

3. The apparatus as claimed in claim 2, said ring twister being a multiposition ring twister and including means for regulating the compressed air so that the supply of air to all positions of the ring twister may be controlled simultaneously or individually.

4. The apparatus as claimed in claim 3, including means for rotating said pulleys on all positions on the ring twister simultaneously.

* * * * *